United States Patent [19]

Gybowski

[11] 3,952,446

[45] Apr. 27, 1976

[54] TOY HAVING LOOSELY MOUNTED CYLINDERS AND SLIDABLE STRIKER

[76] Inventor: Frank Gybowski, 34 Edgewood Way, New Haven, Conn. 06515

[22] Filed: Aug. 8, 1974

[21] Appl. No.: 495,864

[52] U.S. Cl. ..... 46/1 R; 273/143 R; 46/175 R; 46/191

[51] Int. Cl.[2] ..... A63H 5/00

[58] Field of Search ..... 46/191, 193, 192, 175 R, 46/177, 1 R; 273/143 R, 143 A; 84/404

[56] References Cited

UNITED STATES PATENTS

| | | | |
|---|---|---|---|
| 634,579 | 10/1899 | Long et al | 273/143 A |
| 2,056,515 | 10/1936 | Glaser | 273/143 R |
| 2,394,821 | 2/1946 | Teagarden | 46/192 |
| 2,558,464 | 6/1951 | Schultz | 46/191 |
| 2,660,000 | 11/1953 | Strayer | 46/191 X |
| 2,944,823 | 7/1960 | Gilbert | 273/143 R |
| 3,236,008 | 2/1966 | Ryan | 46/191 |
| 3,463,487 | 8/1969 | Tepper | 273/143 R X |

*Primary Examiner*—F. Barry Shay
*Attorney, Agent, or Firm*—DeLio and Montgomery

[57] ABSTRACT

A toy comprising an elongated housing having opposing generally parallel walls, a plurality of rods mounted between the walls in spaced-apart, parallel relationship, each rod carrying a hollow cylinder adapted to swing eccentrically on and around the rod, and a hand-operable member mounted in the housing and adapted for travel in a path transverse of the axes of the rods, the member having a generally upright tongue-like portion adapted for striking the cylinders during the travel such that the cylinders are sequentially activated.

5 Claims, 5 Drawing Figures

11
18
13
19
21
12
15
24
22
14

11
12
13
14
15
16
17
18
19
21
22
23
24
3

13
14
15
19
21
22
23
24

13
15
19
21
22
23
24

25
26
27
28
29
31
32
33
34
35

TOY HAVING LOOSELY MOUNTED CYLINDERS AND SLIDABLE STRIKER

BACKGROUND OF THE INVENTION

This invention relates to toys and game devices, of the type involving freely swinging cylinders. The device may be essentially noiseless or noise making, as embodied in a game, a toy gun or a noisemaker for use at parties and the like. As a game device, game points are determined by positions of indicia relative to a point of reference either on the cylinders or on other parts of the device.

Noise making toys or devices of many varieties are known, one type being the ratchet and pawl combination wherein a pawl is attached to a hand-holdable rod and a ratchet is enclosed in an elongated housing which is weighted at one end so that it can be made to rotate freely about the axis of the pawl member. Usually, the mechanism of such devices is not readily visible during operation and therefore does not contribute to its amusement value. The toy or game device of this invention is similar to the ratchet and pawl devices in noise making capabilities but is based upon an entirely different construction and principle of operation. At the same time, its amusement value is greatly enhanced by its form of operation which can be readily observed.

Whether as a toy or game device, and whether silent or noise making, a structure which is simple and inexpensive to manufacture while also providing an exceedingly high degree of amusement quality for both children and adults, should contribute greatly to the art.

OBJECTS AND SUMMARY

Accordingly, an object of the invention is to provide a new and improved toy or game device which may be essentially noiseless or noise making.

Another object is to provide a new and improved toy or game device for games of chance or, in other embodiments, for amusement value as a noisemaker, and in all embodiments incorporating a simple and inexpensive mechanism.

These and other objects, features and advantages of the invention will be apparent from the specification which follows.

In brief outline, the primary components of the toy and game device are a housing having two opposing generally parallel walls; a plurality of rods mounted between the walls in spaced apart, parallel relationship; wherein each rod carries a hollow cylinder adapted to swing eccentrically on and around the rod; and a hand operable member mounted in the housing and adapted for travel in a path transverse of the axes of the rods, the member having a generally upright tongue-like portion which tangentially strikes the cylinders during travel of the member such that the cylinders are sequentially activated on the rods.

When the tongue-like portion is flexible and the distance between the upper edge of the tongue-like portion in each of the rods is less than the thickness of the walls of the cylinders, a temporary interference fit is caused between the tongue-like portion and each of the cylinders during movement of the hand-operable member. The effect is a staccato-like sound similar to the rat-tat-tat of a machine gun.

As a game device either the cylinders or adjacent structure of the toy may carry game indicia so that when a cylinder comes to rest on a rod, the rest position will indicate game points.

The invention accordingly comprises a toy possessing the features, properties and the relation of elements which will be exemplified in the article hereinafter described, and the scope of the invention will be indicated in the claims.

DETAILED DESCRIPTION

For a fuller understanding of the nature and objects of the invention, reference is made to the following description taken in conjunction with the accompanying drawing, in which.

Figure 1:
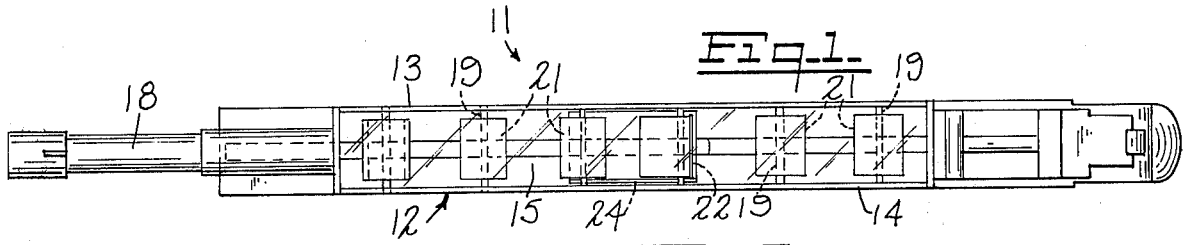
FIG. 1 is a diagrammatic top view of a toy of the invention on a reduced scale.

With reference to FIGS. 1–4, one embodiment of a toy 11 of the invention is the toy machine gun illustrated. The toy includes an elongated housing 12 having generally parallel side walls 13 and 14, and, optionally, a top wall 15. The amusement value of the toy is enhanced if such walls are constructed of a transparent material, such as transparent plastic. The transparency permits viewing of the action of the cylinders within, as explained below.

In the embodiment shown, the toy includes at one end a hand grip 16 and a trigger 17 which may be a dummy or operable, if desired, but which has no functional relationship to other moving parts of the toy. The opposite end of the housing 12 may carry a simulated gun barrel 18.

A plurality of support members such as rods 19 are mounted parallel between walls 13 and 14 in spaced-apart relationship. Each of the rods 19 carries a hollow cylinder 21. The cylinders hang loosely on the rods and can be made to swing eccentrically on and around the rods when sequentially contacted or struck by an L-shaped tongue-like portion 22 of a hand-operable member 23. The member 23 is mounted in any suitable manner in the housing 12 for reciprocating, sliding movement therein. As shown most clearly in FIG. 3, one form of mounting is the utilization of a T-shaped upper portion 24 which slidingly mates with bottom wall portions formed by a slot in the bottom of the housing 12. Many other modes of sliding engagement of the member 23 with the housing 12, however, may be utilized and will be apparent.

Figure 4:
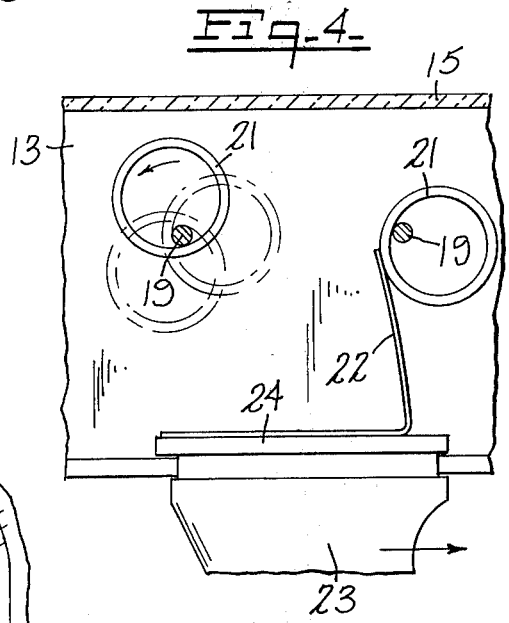
FIG. 4 is a detail of a portion of the toy shown in FIG. 2.

In operation, the handle 16 is held in one hand and the member 23 is held in the other hand, the member 23 then being slidingly reciprocated to the left as shown by the arrow in FIG. by the arrow in FIG. 4. As by the arrow in FIG. 4. as most evident in FIGS. 2 and 4, the reciprocating, sliding action causes the tongue-like portion 22 to strike either the rear wall of a cylinder 21 (FIG. 2) or the forward wall of a cylinder 21 (FIG. 4), causing each cylinder in turn to swing or "flip" eccentrically on and around the bar 19 upon which each cylinder is loosely carried.

In a preferred form the tongue-like portion 22 is flexible or vibratable like a reed.

The flexing of the tongue-like portion 22 at contact with the cylinders greatly enhances the action of the cylinders on the rods since the flexing stores up energy which is released against the next cylinder as the tongue-like portion slides under each of the cylinders and snaps back towards an upright position. The increased force with which the portion 22 strikes the cylinders of course causes them to jump and gyrate wildly about the rods. At the same time the dissipation of this energy potential results in the generation of considerable explosive noise.

These effects are maximized when the distance between the upper edge of the tongue-like portion 22 and each of the rods is slightly less than the thickness of the walls of the cylinders. Under this condition a momentary interference fit is effected between the tongue-like portion and the walls of each of the cylinders during travel of the tongue-like portion. As indicated, the resulting snap-back of the tongue-like portion is accompanied by an explosion-like sound. Several of such sounds in sequence, during reciprocal travel of the member 23, give a staccato effect, simulating the firing of a machine gun. If the housing 12 is substantially closed, the housing will form a sounding board type chamber and the explosion-like sounds will be magnified. Of course, if such explosion-like or staccato effect is not desired, the vertical dimension of the tongue-like portion 22 can be shortened so that the temporary interference fit which contributes to the sound is avoided.

The use of a transparent housing material contributes greatly to the amusement value of the toy since the unique action of the cylinder's movement about the rods can then be observed. Also adding to the amusement value of the toy is the fact that the considerably great energy imparted to the cylinders, as they are struck by the tongue-like portion 22, actually causes the toy as a whole to vibrate. This simulates the action of a machine gun, for example. It will be evident that absent the simulated appearance of a machine gun, the toy 11 may be primarily a noisemaker.

Figure 5:
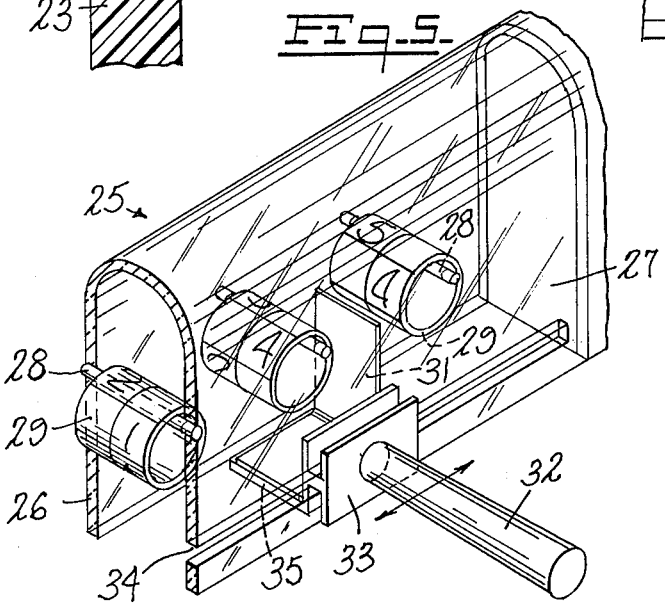
FIG. 5 is a partially diagrammatic perspective view of another embodiment of toy of the invention, utilizable primarily as a noisemaker or game device by the accumulation of game points.

In another embodiment, shown in FIG. 5, the toy of the invention may be utilized as a noisemaker or as a game device, whether noise making or noiseless. With reference to FIG. 5, the device 25 includes a housing having generally parallel side walls 26 and 27 between which are mounted in parallel, spaced apart relationship a plurality of rods 28. As in the embodiment of FIGS. 1–4, the rods 28 loosely carry cylinders 29 which may be caused sequentially to swing eccentrically on and around the rods when struck by the L-shaped, tongue-like portion 31 of a member which includes a hand-holdable grip 32 and an H-shaped support 33 slidably received in a slot 34 in wall 27. A plate 35 connected to one leg of the H-shaped member 33 carries the tongue-like portion 31.

As the member 32 is slidingly reciprocated, the tongue-like portion 31 actuates the cylinders 29 essentially as described with reference to similar structure in FIGS. 1–4. Preferably, tongue-like portion 31 is flexible so that the "jumping" of the cylinders on the rods is enhanced. Also, the parts may be arranged to provide the same temporary interference fit as in the embodiment of FIGS. 1–4, to improve the noisemaking properties of the device. However, the cylinders 29 additionally may each carry indicia, as shown, so that when the cylinders come to rest on the rods 28, game points may thereby be determined by reference to some fixed point, for example, a window or line (not shown) in or on the top wall of the housing. The action, whether noiseless or noise making, is essentially the same as described with reference to FIGS. 1–4. Of course the member 32 may also take the form shown in FIGS. 1–2, that is, mounting in a bottom wall of the device. Construction of the housing from a transparent material such as a transparent plastic contributes to the amusement value since the novel action of the cylinders can be observed and game points determined.

The construction material of the toy may be plastic, wood, metal or any combination thereof. From the standpoint of cost and ease of manufacture, plastic is preferred.

In view of the foregoing description it will be apparent that the invention is not limited to the specific details set forth therein for the purposes of illustration, and that various other modifications are equivalent for the stated and illustrated functions without departing from the spirit and scope of the invention.

What is claimed is:

1. A toy comprising the combination of:

a housing having two opposing, generally parallel walls;

a plurality of rods mounted between said walls in parallel, spaced apart rectilinear relationship;

each said rod loosely carrying a hollow cylinder adapted to swing eccentrically on and around said rod; and a hand operable member slidably mounted in said housing; guide means in said housing defining a generally longitudinal path of travel for said member transverse to the axes of said rods, said member having a generally upright tongue-like portion extending upwardly to a height sufficient for tangentially striking said cylinders during said travel of said member, whereby said cylinders are sequentially activated on said rods when said member is moved along said path.

2. A toy as in claim 1 wherein said tongue-like portion is flexible and the distance between the upper edge of said tongue-like portion and each of said rods is less than the thickness of the walls of said cylinders, whereby an interference fit is temporarily effected between said tongue-like portion and each of said cylinders during said travel.

3. A toy as in claim 1 wherein said housing includes a top wall.

4. A toy as in claim 1 wherein said walls are transparent.

5. A toy as in claim 1 further including a barrel and a handle, said handle carrying a trigger, whereby said toy resembles a machine gun.

* * * * *

UNITED STATES PATENT AND TRADEMARK OFFICE

CERTIFICATE OF CORRECTION

PATENT NO. : 3,952,446

DATED : April 27, 1976

INVENTOR(S) : Frank Gybowski

It is certified that error appears in the above-identified patent and that said Letters Patent are hereby corrected as shown below:

Column 1, line 18, after "and", "a" should read --the--.

Figure 2:
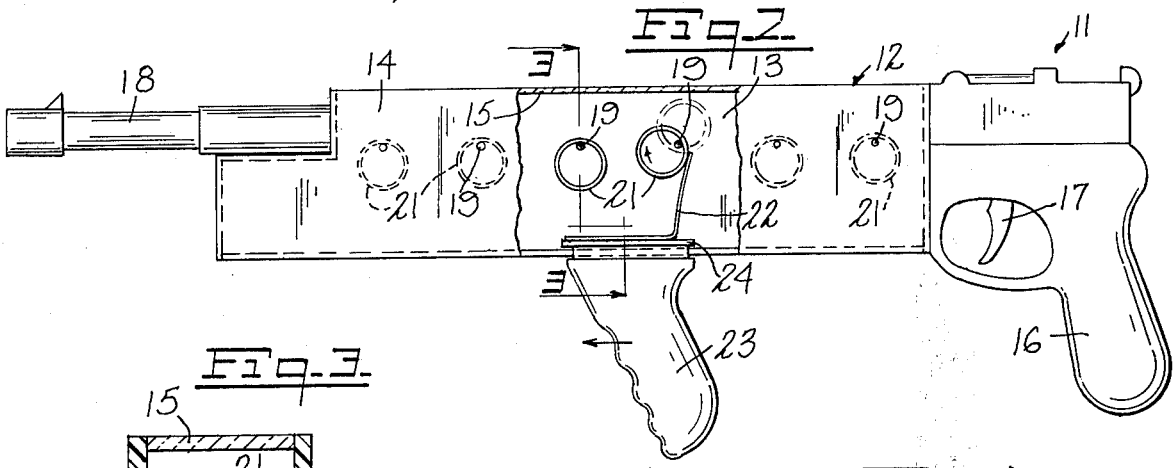
FIG. 2 is a diagrammatic side view of the same toy.
Figure 3:
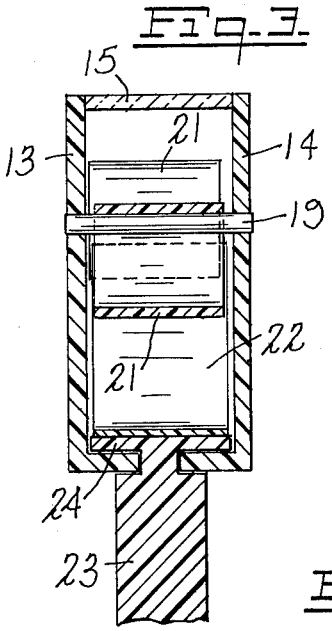
FIG. 3 is a somewhat enlarged vertical section along the line 3—3 of FIG. 2.

Column 2, lines 59 and 60 should be deleted in their entirety and the following should be substituted: --by the arrow in FIG. 2, or to the right as shown by the arrow in FIG. 4. As most evident in FIGS. 2 and 4, the--.

Column 3, line 33, "cylinder's" should read --cylinders'--.

Column 4, line 12 of claim 1, "transverse to" should read --transverse of--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*